United States Patent [19]

Goff

[11] 3,942,431

[45] Mar. 9, 1976

[54] PRESS HAVING TRAVELLING DIE SET

[75] Inventor: Lawrence J. Goff, Parchment, Mich.

[73] Assignee: General Machine Industries Corporation, Kalamazoo, Mich.

[22] Filed: May 1, 1974

[21] Appl. No.: 465,730

[52] U.S. Cl. ..... 100/53; 72/448; 83/400; 100/224; 100/229 R; 100/DIG. 18; 425/150; 425/152; 192/134

[51] Int. Cl.[2] ..... B30B 15/02

[58] Field of Search ..... 72/419, 421, 448; 83/400, 83/426, 435.1; 425/150, 151, 152, 408; 100/53, 215, 218, 229 R, DIG. 18, 224; 192/134

[56] References Cited

UNITED STATES PATENTS

| | | | |
|---|---|---|---|
| 2,988,234 | 6/1961 | Barothy et al. | 100/DIG. 18 |
| 3,446,106 | 5/1969 | Ferris et al. | 83/400 |
| 3,818,748 | 6/1974 | Smit | 72/448 |
| 3,832,875 | 9/1974 | Newman | 72/448 X |
| 3,848,721 | 11/1974 | Smit | 192/134 X |

FOREIGN PATENTS OR APPLICATIONS

| | | | |
|---|---|---|---|
| 592,737 | 9/1947 | United Kingdom | 192/134 |
| 777,110 | 6/1957 | United Kingdom | 100/DIG. 18 |

*Primary Examiner*—Billy J. Wilhite
*Attorney, Agent, or Firm*—Gordon W. Hueschen

[57] ABSTRACT

A press comprising a base, a lower bolster mounted on the press, an upper bolster mounted on the press for movement with respect to the lower bolster, power means for moving the upper bolster vertically, a substantially horizontal track mounted on the base, a die set comprising a pair of die plates having post means guiding the plates for movement with respect to each other, means for guiding the die set on the track, and power means for causing the die set to travel back and forth along the track between a press position intermediate the upper and lower bolsters, and a loading and unloading position at a point remote from the press position. The apparatus may be used for molding metal or plastic material, blanking, stamping and piercing.

5 Claims, 4 Drawing Figures

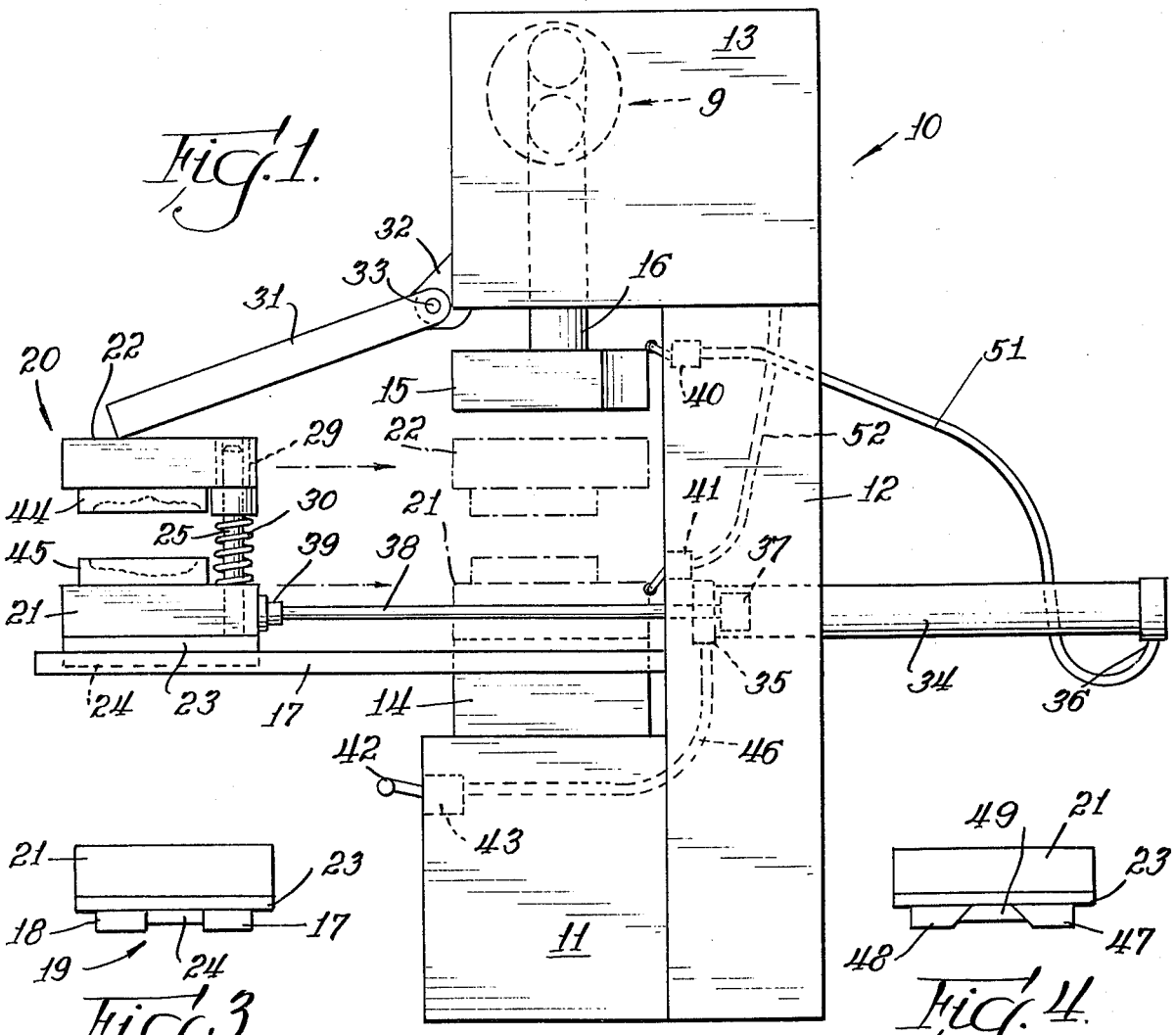
Fig. 1.
Fig. 3.
Fig. 4.
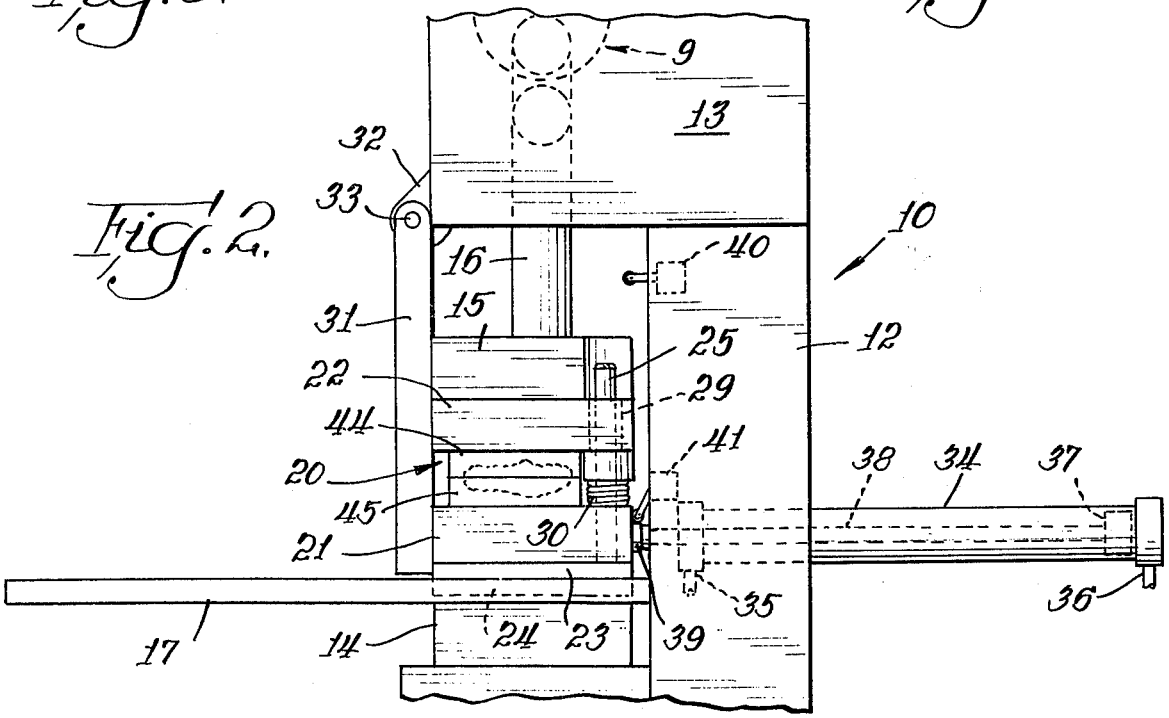
Fig. 2.

PRESS HAVING TRAVELLING DIE SET

BACKGROUND OF THE INVENTION

1. Field Of Invention

The present invention relates to presses, and is more particularly concerned with a press of the type comprising means for clamping together the member of a die set having members mounted therebetween for such processes as the molding of plastics or metals, blanking, stamping and piercing.

2. Prior Art

Molding machines for molding plastics or metals as well as machines for blanking, stamping and piercing are well known in the art. Such presses generally include a stationary plate or bolster mounted on a base and a movable plate mounted for up-and-down or lateral movement with respect to the stationary plate. Die sets are generally utilized in which one member is affixed to the lower bolster and the other member to the upper bolster. Complementary mold members are generally mounted on the die set plates. The upper bolster is generally powered by either a hydraulic cylinder or a toggle assembly causing it to clamp the die set against the lower bolster under high pressure. Such types of apparatus have many disadvantages. First, it is dangerous for the operator to reach between the bolsters with his hands to load the moldable material and remove the finished molded products, since the bolsters may be accidentally actuated with resulting injury to the operator. Moreover, it is difficult and time consuming to perform such an operation. Additionally, it is difficult to change dies when they are permanently mounted on the bolsters. Molding machines have been disclosed in which the lower bolster and lower die plate are moved out of the molding position for unloading, but in doing so the upper die plate must be moved off the leader pins with resultant danger of their destruction.

SUMMARY OF THE INVENTION

Accordingly, it is an object of the present invention to provide a press and die set in which the die set is not permanently affixed to the bolsters of the press. It is a further object to provide a press in which the entire die set is automatically removed from the molding position between the bolsters when the molding operation is complete. It is still an additional object to provide a press in which the die set may be loaded and unloaded at a remote position from the press position. It is still an additional object to provide a die set in which the die set automatically opens to a position with the die members in spaced-apart condition permitting the molded or stamped object or article to be removed when the upper bolster is retracted. It is a further object to provide a press having protective gate means on the front of the press to prevent the operator from extending his hands between the bolsters when the die set is in the molding or stamping position. Still other objects will readily present themselves to one skilled in the art upon reference to the ensuing specification, the drawing, and the claims.

BRIEF DESCRIPTION OF THE DRAWING

In the drawing,

FIG. 1 is a side elevational view of the press according to the invention, showing the apparatus in the loading position, and FIG. 2 is a fragmentary side elevational view showing the press in molding or stamping position, and FIG. 3 is a fragmentary front elevational view showing a modified form of the lower die plate mounted on the track members, and FIG. 4 is a fragmentary front view showing a modified embodiment for mounting the lower die plate on the track members.

DESCRIPTION OF THE PREFERRED EMBODIMENTS

Referring to FIGS. 1–3, a press 10 according to the invention is shown, comprising a base 11, a vertical frame 12 and an upper frame 13. A lower bolster 14 is affixed to the frame base 11 and an upper bolster 15 is affixed to a shaft 16 slidably mounted for vertical movement in the upper frame 13 and powered by suitable power means including a hydraulic cylinder or toggle assembly (not shown), or eccentric crank 9 (as shown). In certain embodiments, a ram plate may be affixed to the shaft and the upper bolster removably affixed to the ram plate.

A pair of track members or rails 17 and 18 are affixed to the lower bolster 14 defining a space 19 therebetween. A die set 20 is mounted on the track members 17 and 18 and comprises a lower die plate 21 and an upper die plate 22. The lower die plate 21 is mounted on a slide plate 23 having a guide 24 affixed thereto and disposed intermediate the track members 17 and 18.

The lower die plate 21 is provided with a pair of apertures having a pair of posts or guide pins 25 mounted therein. The upper die plate 22 is provided with apertures having bushings 29 mounted therein, the bushings 29 being arranged to travel slidably on the posts 25. A coil compression spring 30 is mounted on each post 25, alternatively can be anywhere between the plates, although not mounted on a post, and is arranged to bias the lower and upper die plates to spaced-apart position. A pair of mold members 44 and 45 are shown affixed to the upper die plate 22 and lower die plate 21 respectively.

A protective cover or gate 31 is hingedly mounted on ears 32 affixed to the upper frame 13 by means of hinge pins 33. A hydraulic cylinder 34 operated by either air or a hydraulic liquid is mounted on the press frame and has a first port 35 and a second port 36. Slidably mounted inside the cylinder 34 is a piston 37 affixed to a piston rod 38 which in turn is affixed at the other end by means of a fitting 39 to the lower die plate 21. A fluid valve 40 is connected to the second port 36 by means of a tube or hose 51. Another fluid valve 41 is connected by a tube or hose 52 to trip the press, thereby causing the upper bolster 15 to descend and clamp the die plates together. A pair of levers 42 operate valves 43 to apply fluid through a tube 46 to the first port 35.

FIG. 4 illustrates a modified embodiment of the invention in which the lower die plate 21 and slide plate 23 are mounted on tracks 47 and 48 oblique inner edges. The guide plate 49 is provided with complementary oblique edges, the two structures forming a dovetail arrangement which retains the moving structure against the track members 47 and 48 and prevents the lower plate member from being raised away from the track members during travel.

The molding press of the present invention is in normal rest position as shown in the solid lines in FIG. 1. In order to place the press into operation, the two hand-operated levers 42 are actuated to open the valve 43 to which they are attached. This causes the fluid, either air or a hydraulic liquid, to be pumped into the port 35. The fluid pressure causes the piston 37 to move toward the other end of the hydraulic cylinder 34, thereby pulling the die set 20 into molding position between the lower bolster 14 and the upper bolster 15. The die set 20 slides on the track member 17 and 18 and is guided by the guide 24. When the die set reaches the molding position, it engages the lever of the valve 41 and opens the valve, thereby causing hydraulic fluid to be pumped into the tube, tripping the press and causing the press ram or upper bolster to move downwardly against the die set, and causing the die plates to move together and to close the mold. The plastic or metal in the mold is then molded to form while under pressure. After a timed period, the pressure is removed, and the upper bolster is raised, the coil springs 30 causing the die plates to be opened and the molded part to be exposed. As the upper bolster reaches its upper traverse, it trips the valve 40, causing fluid to be pumped into the tube 51, moving the piston 37 to the other end of the cylinder 34, and causing the die set 20 to be pushed out to the loading and unloading position. At this position, with the die plates open, the molded part can be readily removed and the mold reloaded.

As a safety feature of the invention, when the die set is moved into molding position, the door or gate 31 closes, preventing the operator's hands from being accidentally inserted between the mold plates. When the die set 20 travels to the unloading position, the door is automatically raised, permitting the die set to move outwardly.

The molding or blanking press of the present invention has many advantages over prior art presses. In conventional equipment in which the die sets are opened by clamping the upper die member to an upper bolster of the press and clamping the lower die member to the lower bolster of the press, there is considerable danger of injury to the operator. Moreover, additional time is consumed in reaching into the molding position each time to load and unload the molds. The use of hand-operated valves to initiate the cycle by causing the die set to travel into the molding position avoids the need for foot pedals. The avoidance of hand loading enables certain industrial safety standards to be met. By maintaining the upper and lower die plates in engagement at all times, the danger of damaging the plates and the guide posts by disengaging them at each cycle is obviated. Additionally, the use of a die set in which the die plates are spring-biased to normally separated position greatly facilitates the loading and unloading of the molded material and molded parts.

It is to be understood that the invention is not to be limited to the exact details of operation or structure shown and described, as obvious modifications and equivalents will be apparent to one skilled in the art.

I claim:

1. In a press comprising a base, a lower bolster fixedly mounted on said base, an upper bolster mounted on said base above said lower bolster for movement vertically with respect thereto, and power means for moving said upper bolster, the improvement comprising a die set having a lower die plate and an upper die plate superposed over said lower die plate and mounted for movement toward and away from said lower die plate, guide means for maintaining said upper and lower die plates in superposition, means biasing said upper and lower die plates to normally spaced-apart position, and means for moving said die set alternatively to a press position intermediate said upper and lower bolsters and to a loading and unloading position removed from said press position, said last named means comprising a slide plate adapted to support said lower die plate, a pair of forwardly projecting parallel rails mounted on top of said lower bolster and underlying said slide plate, said rails extending beyond the front edge of said bolster a distance such that in the loading position, the die set is completely removed from the work area of the press, and die set guide means projecting downwardly from said slide plate into the space between said rails and having outer sides complementary to the inner sides of said parallel rails.

2. In a press according to claim 1, the improvement wherein the inner surfaces of said rails are provided with obliquely disposed surfaces and the outer surfaces of said die plate guide means are provided with complementary obliquely disposed surfaces thereby cooperating to define a dove-tail assembly.

3. In a press according to claim 1, the improvement wherein a fluid-operated cylinder is mounted on said press having a piston disposed therein and a piston rod connected to said piston at one end and coupled to said die set at the other end.

4. In a press according to claim 3, the improvement wherein a plurality of valve means are provided comprising a hand-operated valve arranged upon actuation to introduce fluid into one end of said fluid-operated cylinder thereby actuating said fluid-operated cylinder for moving said die set from said loading and unloading position to said press position, a second valve is mounted to be actuated by said die set when it reaches the press position, thereby tripping said press mechanism and causing said bolsters to be closed, and a third valve is mounted to be actuated by said upper bolster when it reaches the open position after the press operation has taken place arranged to provide fluid to said hydraulic cylinder to cause said die set to be returned to the loading and unloading position.

5. In a press according to claim 3, the improvement wherein a plurality of hand-operated valve means arranged upon actuation to introduce fluid into one end of said fluid-operated cylinder, thereby actuating said fluid-operated cylinder for moving said die set from said loading and unloading position to said press position, and a second valve mounted to be actuated by said die set when it reaches the press position, thereby tripping said press mechanism and causing said bolsters to be closed.

* * * * *